United States Patent [19]

Krauss

[11] 4,395,803

[45] Aug. 2, 1983

[54] BUCKLE

[75] Inventor: Mark J. Krauss, New York, N.Y.

[73] Assignee: American Cord & Webbing Co., Inc., New York, N.Y.

[21] Appl. No.: 251,062

[22] Filed: Apr. 6, 1981

[51] Int. Cl.[3] ..... A44B 11/00

[52] U.S. Cl. ..... 24/200

[58] Field of Search ..... 24/197, 198, 200

[56] References Cited

FOREIGN PATENT DOCUMENTS 175007 2/1922 United Kingdom ..... 24/200

*Primary Examiner*—Robert Peshock

*Attorney, Agent, or Firm*—Marvin Feldman; Stephen E. Feldman; Jules L. Chaboty

[57] ABSTRACT

A buckle is provided for securing the ends of a web, strap, belt, or the like. A pair of substantially parallel side walls of the buckle are joined by opposite end portions. Each end portion includes an inclining interior surface forming an acute angle with a plane defined by the upper surfaces of the buckle. A pair of parallel cross bars are located between the end portions of the buckle and are connected to each side wall. The cross bars may be substantially oval shaped.

5 Claims, 4 Drawing Figures

BUCKLE

BACKGROUND OF THE INVENTION

The field of the invention relates to buckles for securing the free ends of a web or band.

Buckles have been used to adjust the lengths of webs, bands, belts and the like for many years. A number of patents are directed to such buckles, including U.S. Pat. No. 4,171,555 and the patents cited therein. Suggested uses include securing straps for lifejackets, backpacks, and garments. U.S. Pat. No. 1,324,629 provides a buckle for binding the straps about packages. Other uses can be envisioned for these devices.

SUMMARY OF THE INVENTION

The invention is directed to a buckle which may be economically manufactured and which has a pair of opposing ends where the free extremities of a belt or strap may be secured and adjusted.

A pair of substantially parallel side walls of the buckle are joined by opposite end portions. Each end portion includes an inclining interior surface forming an acute angle with a plane defined by the upper surfaces of the buckle. The inclining surfaces may be rounded slightly.

A pair of cross bars located between the end portions of the buckle also connect the side walls thereof. The cross bars are substantially parallel to each other and the end portions, and are accordingly substantially perpendicular to the side walls. Each is positioned approximately the same distance from the end portions. The cross bars may be substantially oval shaped.

DETAILED DESCRIPTION OF A PREFERRED EMBODIMENT

Figure 1:
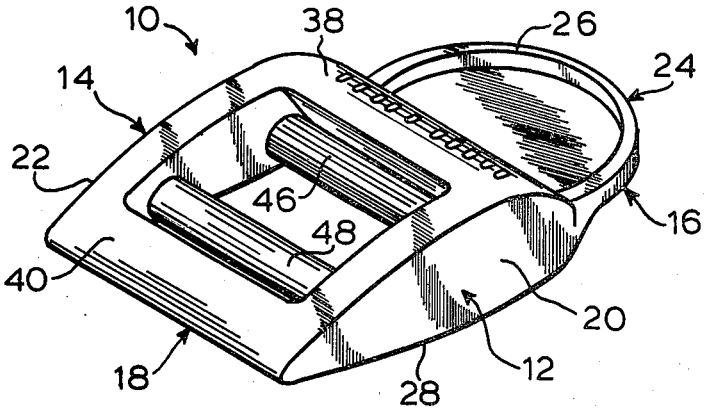
FIG. 1 is a perspective view of a buckle made in accordance with the invention.
Figure 2:
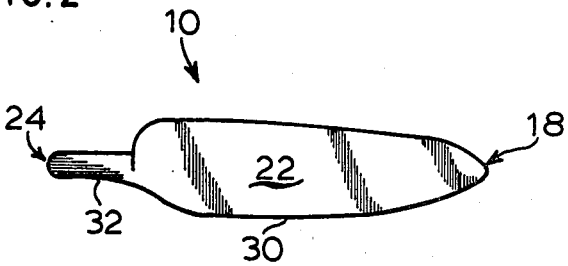
FIG. 2 is a side elevation view of the buckle shown in FIG. 1.

An integrally molded plastic buckle 10 is provided by the invention. The buckle is designed to permit the free ends of a belt to be adjustably secured to either end thereof with a minimum of effort. Removal of the belt will also be facilitated by the present construction.

The buckle 10 includes a pair of parallel side walls 12, 14 of similar configuration connected by opposing end portions 16, 18. Each side wall has a rounded exterior surface designated by numerals 20, 22, respectively.

One end portion 16 includes a semicircular thumb tab 24 projecting outwardly with respect to the remainder of the buckle. An upwardly projecting ridge 26 borders the upper surface thereof. The lower edges 28, 30 of the side walls 12, 14 form a smooth transition with the lower flat surface 32 of the tab 24 at their junction. The side walls have a maximum height near the thumb tab. The distance between its upper and lower edges decreases in the direction of the opposite end portion 18. It will be appreciated that the terms "upper" and "lower" are used arbitrarily for descriptive purposes only.

Figure 4:
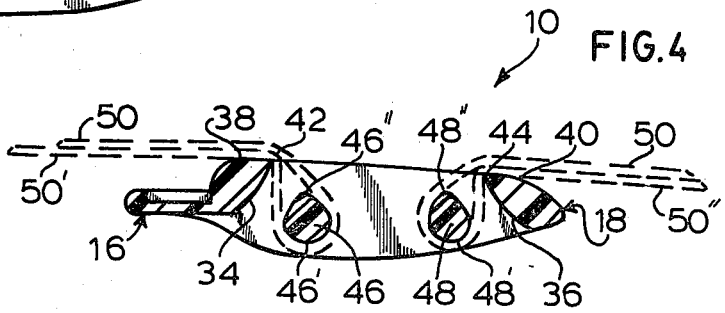
FIG. 4 is a sectional view taken along the plane of lines 4—4 of FIG. 3.
Figure 3:
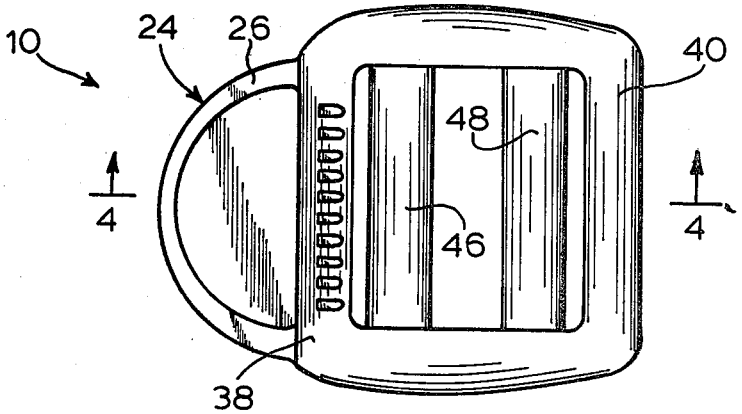
FIG. 3 is a top view of the buckle shown in FIG. 1.

As best shown in cross section in FIG. 4, each of the end portions 16, 18 includes an upwardly inclining and an inwardly projecting interior surface 34, 36. The inclining surface 34 of one end portion 16 adjoins a flat upper surface 38 thereof. A plurality of grooves are provided on this upper surface 38. An acute angle is formed between surfaces 34, 38.

Surface 36 has approximately the same angle of inclination as surface 34. It adjoins an arcuate upper surface 40 of end portion 18 giving the entire end portion a tear-drop configuration. Both inclined surfaces may be slightly rounded. The sharp edges 42, 44 formed by the above described adjoining surfaces 34, 38 and 36, 40 define an upper plane of the buckle 10.

A pair of parallel cross bars 46, 48 extend between the side walls 12, 14. Each cross bar is positioned below the plane defined by edges 42, 44. Both have a substantially oval configuration with a relatively wide rounded bottom portion 46', 48' and a relatively narrow rounded top portion 46'', 48''. These constructions have been found to facilitate insertion, removal, and adjustment of a web (shown in phantom as 50). Each bar 46, 48 is substantially parallel to edges 42, 44.

In use, a web 50 having free ends 50', 50'' is inserted between the respective end portions and cross bars as shown in the drawings. To adjust the web using one free end 50' thereof, the thumb tab is first lowered. Depending upon whether one wishes to lengthen or shorten the web, either the free end 50' or the web portion adjacent thereto is pulled. The thumb tab is raised if the adjustment is made using the other end of the web.

A buckle has accordingly been provided by the invention which is well suited for its intended purposes and allows a web to be adjusted at either end thereof.

What is claimed is:

1. A buckle for securing a web, strap, or belt thereto, consisting of, first and second opposing side walls; first and second opposing end portions attached, respectively, to said opposing side walls, each of said end portions and said side walls having upper and lower surfaces and interior or exterior surfaces, each of said end portions including an upwardly inclining and inwardly projecting surface adjoining the upper surface thereof to form edges, wherein each of the respective edges forms an angle of less than 90°, and the edges formed by said adjoining surfaces defining an upper plane of said buckle; and wherein only the two said edges engage opposite ends the strap in the upper plane, and further consisting of a pair of substantially parallel cross-bars extending between and connected to the interior surfaces of said side walls and being disposed in substantially the same plane below said upper plane, said said cross bars being positioned between said end portions and below said upper plane of said buckle; wherein each of said bars comprises upper and lower rounded surfaces wherein each upper rounded surface is facingly disposed to a said respective end portion edge, and the lower rounded surface is remotely disposed from the respective end portion edge, so that the web overlies the rounded surfaces of the cross bar with a portion of the web engaging the respective edge at about 90° to the upper surface.

2. A buckle as defined in claim 1 where each of said cross bars is substantially oval-shaped, each cross bar having a relatively large lower rounded surface and a relatively small upper rounded surface.

3. A buckle as defined in claim 1 wherein one of said end portions includes a thumb tab which projects therefrom in a direction opposite from the other end portion.

4. A buckle as defined in claim 1 having an integrally molded structure.

5. A buckle as defined in claim 1 wherein said cross-bars are substantially parallel to said edges and perpendicular to said side walls.

* * * * *